US006976647B2

(12) United States Patent
Reed et al.

(10) Patent No.: US 6,976,647 B2
(45) **Date of Patent: *Dec. 20, 2005**

(54) SYSTEM AND METHOD FOR MILLING MATERIALS

(75) Inventors: Robert G. Reed, Birdsboro, PA (US); David Czekai, Spring City, PA (US)

(73) Assignee: Elan Pharma International, Limited, Dublin (IE)

( * ) Notice: Subject to any disclaimer, the term of this patent is extended or adjusted under 35 U.S.C. 154(b) by 178 days.

This patent is subject to a terminal disclaimer.

(21) Appl. No.: 10/732,801

(22) Filed: Dec. 11, 2003

(65) Prior Publication Data

US 2004/0164194 A1 Aug. 26, 2004

Related U.S. Application Data

(63) Continuation-in-part of application No. 10/162,333, filed on Jun. 4, 2003, now Pat. No. 6,742,734.

(60) Provisional application No. 60/295,965, filed on Jun. 5, 2001.

(51) Int. Cl.[7] ..... B02C 17/16
(52) U.S. Cl. ..... 241/30; 241/172; 241/184
(58) Field of Search ..... 241/172, 184, 241/30

(56) References Cited

U.S. PATENT DOCUMENTS

| | | | |
|---|---|---|---|
| 4,620,673 | A | 11/1986 | Canepa et al. |
| 4,645,131 | A | 2/1987 | Hailey |
| 4,856,717 | A | 8/1989 | Kamiwano et al. |
| 4,870,875 | A | 10/1989 | Morishita |
| 5,118,528 | A | 6/1992 | Fessi et al. |
| 5,145,684 | A | 9/1992 | Liversidge et al. |
| 5,298,262 | A | 3/1994 | Na et al. |
| 5,302,401 | A | 4/1994 | Liversidge et al. |
| 5,318,767 | A | 6/1994 | Liversidge et al. |
| 5,326,552 | A | 7/1994 | Na et al. |
| 5,328,404 | A | 7/1994 | Bacon |
| 5,336,507 | A | 8/1994 | Na et al. |
| 5,340,564 | A | 8/1994 | Illig et al. |
| 5,346,702 | A | 9/1994 | Na et al. |
| 5,349,957 | A | 9/1994 | Yudelson |
| 5,352,459 | A | 10/1994 | Hollister et al. |
| 5,399,363 | A | 3/1995 | Liversidge et al. |
| 5,401,492 | A | 3/1995 | Kellar et al. |
| 5,429,824 | A | 7/1995 | June |
| 5,447,710 | A | 9/1995 | Na et al. |
| 5,451,393 | A | 9/1995 | Liversidge et al. |
| 5,466,440 | A | 11/1995 | Ruddy et al. |
| 5,470,583 | A | 11/1995 | Na et al. |
| 5,472,683 | A | 12/1995 | Illig |
| 5,494,683 | A | 2/1996 | Liversidge et al. |

(Continued)

FOREIGN PATENT DOCUMENTS

| | | |
|---|---|---|
| EP | 275 796 | 7/1988 |

(Continued)

OTHER PUBLICATIONS

Magna-Safe™, www.magnasafe.com, 2 pgs.*

*Primary Examiner*—Mark Rosenbaum
(74) *Attorney, Agent, or Firm*—Foley & Lardner LLP

(57) ABSTRACT

A system for milling at least one material, e.g., a drug, is described. The system includes a milling apparatus. In another embodiment of the invention, the system includes at least one milling medium. The milling apparatus includes a chamber having a rotary milling head located in it. The milling head is rotated within the chamber by a magnetic drive system.

56 Claims, 2 Drawing Sheets

U.S. PATENT DOCUMENTS

| | | | | |
|---|---|---|---|---|
| 5,500,204 | A | 3/1996 | Osifo | |
| 5,510,118 | A | 4/1996 | Bosch et al. | |
| 5,518,187 | A | 5/1996 | Bruno et al. | |
| 5,518,738 | A | 5/1996 | Eickhoff et al. | |
| 5,521,218 | A | 5/1996 | Osifo | |
| 5,525,328 | A | 6/1996 | Bacon et al. | |
| 5,543,133 | A | 8/1996 | Swanson et al. | |
| 5,552,160 | A | 9/1996 | Liversidge et al. | |
| 5,560,931 | A | 10/1996 | Eickhoff et al. | |
| 5,565,188 | A | 10/1996 | Wong et al. | |
| 5,569,448 | A | 10/1996 | Wong et al. | |
| 5,571,536 | A | 11/1996 | Eickhoff et al. | |
| 5,573,749 | A | 11/1996 | Illig | |
| 5,573,750 | A | 11/1996 | Singh | |
| 5,573,783 | A | 11/1996 | Desieno et al. | |
| 5,580,579 | A | 12/1996 | Ruddy et al. | |
| 5,585,108 | A | 12/1996 | Ruddy et al. | |
| 5,587,143 | A | 12/1996 | Wong | |
| 5,591,456 | A | 1/1997 | Franson et al. | |
| 5,593,657 | A | 1/1997 | Ruddy et al. | |
| 5,622,938 | A | 4/1997 | Wong | |
| 5,628,981 | A | 5/1997 | Liversidge et al. | |
| 5,643,552 | A | 7/1997 | Illig | |
| 5,718,388 | A | 2/1998 | Czekai et al. | |
| 5,718,919 | A | 2/1998 | Ruddy et al. | |
| 5,747,001 | A | 5/1998 | Wiedmann et al. | |
| 5,834,025 | A | 11/1998 | De Garavilla et al. | |
| 5,862,999 | A | 1/1999 | Czekai et al. | |
| 6,045,829 | A | 4/2000 | Liversidge et al. | |
| 6,068,858 | A | 5/2000 | Liversidge et al. | |
| 6,153,225 | A | 11/2000 | Lee et al. | |
| 6,165,506 | A | 12/2000 | Jain et al. | |
| 6,221,400 | B1 | 4/2001 | Liversidge et al. | |
| 6,264,922 | B1 | 7/2001 | Wood et al. | |
| 6,267,989 | B1 | 7/2001 | Liversidge et al. | |
| 6,270,806 | B1 | 8/2001 | Liversidge et al. | |
| 6,316,029 | B1 | 11/2001 | Jain et al. | |
| 6,375,986 | B1 | 4/2002 | Ryde et al. | |
| 6,428,814 | B1 | 8/2002 | Bosch | |
| 6,431,478 | B1 | 8/2002 | Reed et al. | |
| 6,432,381 | B2 | 8/2002 | Liversidge et al. | |
| 6,592,903 | B2 | 7/2003 | Ryde et al. | |
| 6,742,734 | B2 * | 6/2004 | Reed et al. | 241/172 |
| 2001/0022964 | A1 | 9/2001 | Leung et al. | |
| 2002/0012675 | A1 | 1/2002 | Jain et al. | |
| 2004/0195413 | A1 * | 10/2004 | Reed et al. | 241/172 |

FOREIGN PATENT DOCUMENTS

| | | |
|---|---|---|
| EP | 0 322 623 | 7/1989 |
| GB | 947 530 | 1/1964 |
| WO | WO 02/098565 A1 | 12/2002 |

* cited by examiner

SYSTEM AND METHOD FOR MILLING MATERIALS

CROSS-REFERENCE TO RELATED APPLICATIONS

This application is a continuation-in-part of U.S. application Ser. No. 10/162,333, filed on Jun. 4, 2003, now U.S. Pat. No. 6,742,734, which claims benefit of U.S. provisional Application No. 60/295,965, filed on Jun. 5, 2001.

FIELD OF THE INVENTION

This invention relates to milling of materials and more particularly to systems including magnetic drives for milling materials and methods of use of the same.

BACKGROUND OF THE INVENTION

In U.S. Pat. No. 5,518,187, which is assigned to the same assignee as this invention and whose disclosure is incorporated by reference herein, there is disclosed a method of preparing particles of a drug or a diagnostic agent material. The method entails grinding the material in the presence of a grinding media, e.g., particles of a polymeric resin or ceramic. The polymeric resin grinding media can have a density from 0.8 to 3.0 g/cm$^3$, and can range in size from about 0.1 to 3 mm. For fine grinding, the grinding media particles preferably are from 0.2 to 2 mm, and more preferably 0.25 to 1 mm in size. Alternatively, the grinding media can comprise particles comprising a core having a coating of the polymeric resin adhered thereon.

In U.S. Pat. No. 5,862,999, which is assigned to the same assignee as this invention and whose disclosure is incorporated by reference herein, there is disclosed a method of preparing submicron particles of a therapeutic or diagnostic agent which comprises grinding the agent in the presence of grinding media having a mean particle size of less than about 75 microns. In a preferred embodiment, the grinding media is a polymeric resin. The method provides extremely fine particles, e.g., less than about 2 microns in size, free of unacceptable contamination.

Small particle or nanoparticulate active agent compositions, first described in U.S. Pat. No. 5,145,684 ("the '684 patent"), are particles consisting of a poorly soluble therapeutic or diagnostic agent having adsorbed onto, or associated with, the surface thereof a non-crosslinked surface stabilizer. The '684 patent describes the use of a variety of surface stabilizers for nanoparticulate compositions. The use of a magnetic mill to make such nanoparticulate active agent compositions is not described by the '684 patent.

Methods of making nanoparticulate active agent compositions are described, for example, in U.S. Pat. No. 5,718,388, for "Continuous Method of Grinding Pharmaceutical Substances;" and U.S. Pat. No. 5,510,118 for "Process of Preparing Therapeutic Compositions Containing Nanoparticles."

Nanoparticulate active agent compositions are also described, for example, in U.S. Pat. No. 5,298,262 for "Use of Ionic Cloud Point Modifiers to Prevent Particle Aggregation During Sterilization;" U.S. Pat. No. 5,302,401 for "Method to Reduce Particle Size Growth During Lyophilization;" U.S. Pat. No. 5,318,767 for "X-Ray Contrast Compositions Useful in Medical Imaging;" U.S. Pat. No. 5,326,552 for "Novel Formulation For Nanoparticulate X-Ray Blood Pool Contrast Agents Using High Molecular Weight Non-ionic Surfactants;" U.S. Pat. No. 5,328,404 for "Method of X-Ray Imaging Using Iodinated Aromatic Propanedioates;" U.S. Pat. No. 5,336,507 for "Use of Charged Phospholipids to Reduce Nanoparticle Aggregation;" U.S. Pat. No. 5,340,564 for "Formulations Comprising Olin 10-G to Prevent Particle Aggregation and Increase Stability;" U.S. Pat. No. 5,346,702 for "Use of Non-Ionic Cloud Point Modifiers to Minimize Nanoparticulate Aggregation During Sterilization;" U.S. Pat. No. 5,349,957 for "Preparation and Magnetic Properties of Very Small Magnetic-Dextran Particles;" U.S. Pat. No. 5,352,459 for "Use of Purified Surface Modifiers to Prevent Particle Aggregation During Sterilization;" U.S. Pat. Nos. 5,399,363 and 5,494,683, both for "Surface Modified Anticancer Nanoparticles;" U.S. Pat. No. 5,401,492 for "Water Insoluble Non-Magnetic Manganese Particles as Magnetic Resonance Enhancement Agents;" U.S. Pat. No. 5,429,824 for "Use of Tyloxapol as a Nanoparticulate Stabilizer;" U.S. Pat. No. 5,447,710 for "Method for Making Nanoparticulate X-Ray Blood Pool Contrast Agents Using High Molecular Weight Non-ionic Surfactants;" U.S. Pat. No. 5,451,393 for "X-Ray Contrast Compositions Useful in Medical Imaging;" U.S. Pat. No. 5,466,440 for "Formulations of Oral Gastrointestinal Diagnostic X-Ray Contrast Agents in Combination with Pharmaceutically Acceptable Clays;" U.S. Pat. No. 5,470,583 for "Method of Preparing Nanoparticle Compositions Containing Charged Phospholipids to Reduce Aggregation;" U.S. Pat. No. 5,472,683 for "Nanoparticulate Diagnostic Mixed Carbamic Anhydrides as X-Ray Contrast Agents for Blood Pool and Lymphatic System Imaging;" U.S. Pat. No. 5,500,204 for "Nanoparticulate Diagnostic Dimers as X-Ray Contrast Agents for Blood Pool and Lymphatic System Imaging;" U.S. Pat. No. 5,518,738 for "Nanoparticulate NSAID Formulations;" U.S. Pat. No. 5,521,218 for "Nanoparticulate Iododipamide Derivatives for Use as X-Ray Contrast Agents;" U.S. Pat. No. 5,525,328 for "Nanoparticulate Diagnostic Diatrizoxy Ester X-Ray Contrast Agents for Blood Pool and Lymphatic System Imaging;" U.S. Pat. No. 5,543,133 for "Process of Preparing X-Ray Contrast Compositions Containing Nanoparticles;" U.S. Pat. No. 5,552,160 for "Surface Modified NSAID Nanoparticles;" U.S. Pat. No. 5,560,931 for "Formulations of Compounds as Nanoparticulate Dispersions in Digestible Oils or Fatty Acids;" U.S. Pat. No. 5,565,188 for "Polyalkylene Block Copolymers as Surface Modifiers for Nanoparticles;" U.S. Pat. No. 5,569,448 for "Sulfated Non-ionic Block Copolymer Surfactant as Stabilizer Coatings for Nanoparticle Compositions;" U.S. Pat. No. 5,571,536 for "Formulations of Compounds as Nanoparticulate Dispersions in Digestible Oils or Fatty Acids;" U.S. Pat. No. 5,573,749 for "Nanoparticulate Diagnostic Mixed Carboxylic Anydrides as X-Ray Contrast Agents for Blood Pool and Lymphatic System Imaging;" U.S. Pat. No. 5,573,750 for "Diagnostic Imaging X-Ray Contrast Agents;" U.S. Pat. No. 5,573,783 for "Redispersible Nanoparticulate Film Matrices With Protective Overcoats;" U.S. Pat. No. 5,580,579 for "Site-specific Adhesion Within the GI Tract Using Nanoparticles Stabilized by High Molecular Weight, Linear Poly(ethylene Oxide)Polymers;" U.S. Pat. No. 5,585,108 for "Formulations of Oral Gastrointestinal Therapeutic Agents in Combination with Pharmaceutically Acceptable Clays;" U.S. Pat. No. 5,587,143 for "Butylene Oxide-Ethylene Oxide Block Copolymers Surfactants as Stabilizer Coatings for Nanoparticulate Compositions;" U.S. Pat. No. 5,591,456 for "Milled Naproxen with Hydroxypropyl Cellulose as Dispersion Stabilizer;" U.S. Pat. No. 5,593,657 for "Novel Barium Salt Formulations Stabilized by Non-ionic and Anionic Stabilizers;" U.S. Pat. No. 5,622,938 for "Sugar Based Surfactant for Nanocrystals;" U.S. Pat. No. 5,628,981 for "Improved Formulations of Oral Gastrointestinal Diagnostic X-Ray Contrast Agents and Oral Gastrointestinal Therapeutic Agents;" U.S. Pat. No. 5,643,552 for "Nanoparticulate Diagnostic Mixed Carbonic Anhydrides as X-Ray Contrast Agents for Blood Pool and Lymphatic System Imaging;" U.S. Pat. No. 5,718,388 for "Continuous Method of Grinding Pharmaceutical Substances;" U.S. Pat. No. 5,718,919 for "Nanoparticles Containing the R(−)Enantiomer of Ibuprofen;" U.S. Pat. No. 5,747,001 for "Aerosols Containing Beclomethasone Nanoparticle Dispersions;" U.S. Pat. No. 5,834,025 for "Reduction of Intravenously Administered Nanoparticulate Formulation Induced Adverse Physiological Reactions;" U.S. Pat. No. 6,045,829 "Nanocrystalline Formulations of Human Immunodeficiency Virus (HIV) Protease Inhibitors Using Cellulosic Surface Stabilizers;" U.S. Pat. No. 6,068,858 for "Methods of Making Nanocrystalline Formulations of Human Immunodeficiency Virus (HIV) Protease Inhibitors Using Cellulosic Surface Stabilizers;" U.S. Pat. No. 6,153,225 for "Injectable Formulations of Nanoparticulate Naproxen;" U.S. Pat. No. 6,165,506 for "New Solid Dose Form of Nanoparticulate Naproxen;" U.S. Pat. No. 6,221,400 for "Methods of Treating Mammals Using Nanocrystalline Formulations of Human Immunodeficiency Virus (HIV) Protease Inhibitors;" U.S. Pat. No. 6,264,922 for "Nebulized Aerosols Containing Nanoparticle Dispersions;" U.S. Pat. No. 6,267,989 for "Methods for Preventing Crystal Growth and Particle Aggregation in Nanoparticle Compositions;" U.S. Pat. No. 6,270,806 for "Use of PEG-Derivatized Lipids as Surface Stabilizers for Nanoparticulate Compositions;" U.S. Pat. No. 6,316,029 for "Rapidly Disintegrating Solid Oral Dosage Form," U.S. Pat. No. 6,375,986 for "Solid Dose Nanoparticulate Compositions Comprising a Synergistic Combination of a Polymeric Surface Stabilizer and Dioctyl Sodium Sulfosuccinate," U.S. Pat. No. 6,428,814 for "Bioadhesive nanoparticulate compositions having cationic surface stabilizers;" U.S. Pat. No. 6,431,478 for "Small Scale Mill;" U.S. Pat. No. 6,432,381 for "Methods for Targeting Drug Delivery to the Upper and/or Lower Gastrointestinal Tract," U.S. Pat. No. 6,582,285 for "Apparatus for Sanitary Wet Milling;" and U.S. Pat. No. 6,592,903 for "Nanoparticulate Dispersions Comprising a Synergistic Combination of a Polymeric Surface Stabilizer and Dioctyl Sodium Sulfosuccinate," all of which are specifically incorporated by reference. In addition, U.S. patent application Ser. No. 20020012675 A1, published on Jan. 31, 2002, for "Controlled Release Nanoparticulate Compositions," and WO 02/098565 for "System and Method for Milling Materials," describe nanoparticulate active agent compositions, and are specifically incorporated by reference. None of these references describe the use of a magnetic mill to make such nanoparticulate active agent compositions.

Agitator mills are known in the patent literature and are commercially available for effecting the milling of drugs, pharmaceuticals and the like. See for example U.S. Pat. No. 4,620,673 (Canepa). In traditional prior art mills an agitator shaft is connected through some means to a motor. The agitator shaft is coupled at one point to a milling head and at another point to the motor. In order to keep the milled product from leaking in the area wherein the drive shaft extends into the mixing chamber, seals of some type, e.g., lip seals or mechanical seals, are used. As is known, lip seals have a rather short life span. Moreover, mechanical seals are somewhat unpredictable insofar as leakage rates and life spans are concerned. Further still, mechanical seals need a lubricant, which is typically purified water for pharmaceutical applications, thereby increasing the complexity of the structure and increasing the risk of contamination of the preparation.

Magnetically coupled mixers and pumps are commercially available for effecting the mixing or pumping of various materials. Examples of such devices are those offered by Magna-Safe International, Inc. of Woodbridge, N.J., under the Trademark MAGNASAFE.

While magnetically coupled mixers and pumps have been used previously for mixing operations, they have not been used or constructed for the production of small particle, or nanoparticle, dispersions, such as the type now being utilized in the pharmaceutical, imaging, electronics and other fields. Thus, a need presently exists for a magnetically coupled media milling machine for the production of small particle dispersions. In such a mill, preferably a chamber or vessel containing the milling media and the material to be milled are located separately and without contact to the driving means that provides the grinding force. Moreover, there is a need for a magnetically coupled media milling machine for the production of small particle dispersions wherein a chamber or vessel containing the milling media and the material to be milled can be removed as an assembly after processing.

SUMMARY OF THE INVENTION

The invention is directed to a system and method for milling at least one material. The system comprises a milling apparatus. In another embodiment, the invention encompasses a milling apparatus and at least one milling medium for use with the apparatus.

The apparatus comprises a milling chamber, a milling head, and a drive member. The milling chamber comprises a hollow vessel for receipt of the at least one material to be milled and the at least one milling medium therein. The drive member includes at least one drive magnet. The milling head is located within the milling chamber and is rotatably mounted with respect thereto. The milling head includes at least one driven magnet. The at least one drive magnet is magnetically coupled to the at least one driven magnet. The drive member is arranged to be rotated by an energy source, e.g., an electric motor, whereupon rotation of the drive member effects the concomitant rotation of the milling head with respect to the milling chamber. The milling head cooperates with the milling medium and with the at least one material to effect the milling of the at least one material within the milling chamber.

In accordance with one exemplary embodiment of the invention, the drive member preferably comprises an elongated drive shaft having a first end portion and a longitudinal axis. The at least one drive magnet is preferably coupled, e.g., mounted, to the drive shaft at the first end portion. The milling head preferably has a central bore. The milling chamber preferably includes a spindle having a well in it. The spindle of the milling chamber is preferably located in the central bore of the milling head but spaced slightly therefrom. The at least one drive magnet is preferably located in the milling head adjacent the central bore. The at least one drive magnet is preferably magnetically coupled to the at least one driven magnet via the spindle. The drive shaft is preferably arranged to be rotated about the longitudinal axis by the energy source, whereupon rotation of the drive shaft about the longitudinal axis effects the concomitant rotation of the milling head about that axis. The milling chamber is preferably removably mounted with respect to the drive shaft so that it can removed as a unit from the drive shaft. A removable cover is preferably provided for the milling chamber.

Both the foregoing general description and the following brief description of the drawings and the detailed description are exemplary and explanatory and are intended to provide further explanation of the invention as claimed. Other objects, advantages, and novel features will be readily apparent to those skilled in the art from the following detailed description of the invention.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENT

Figure 1:
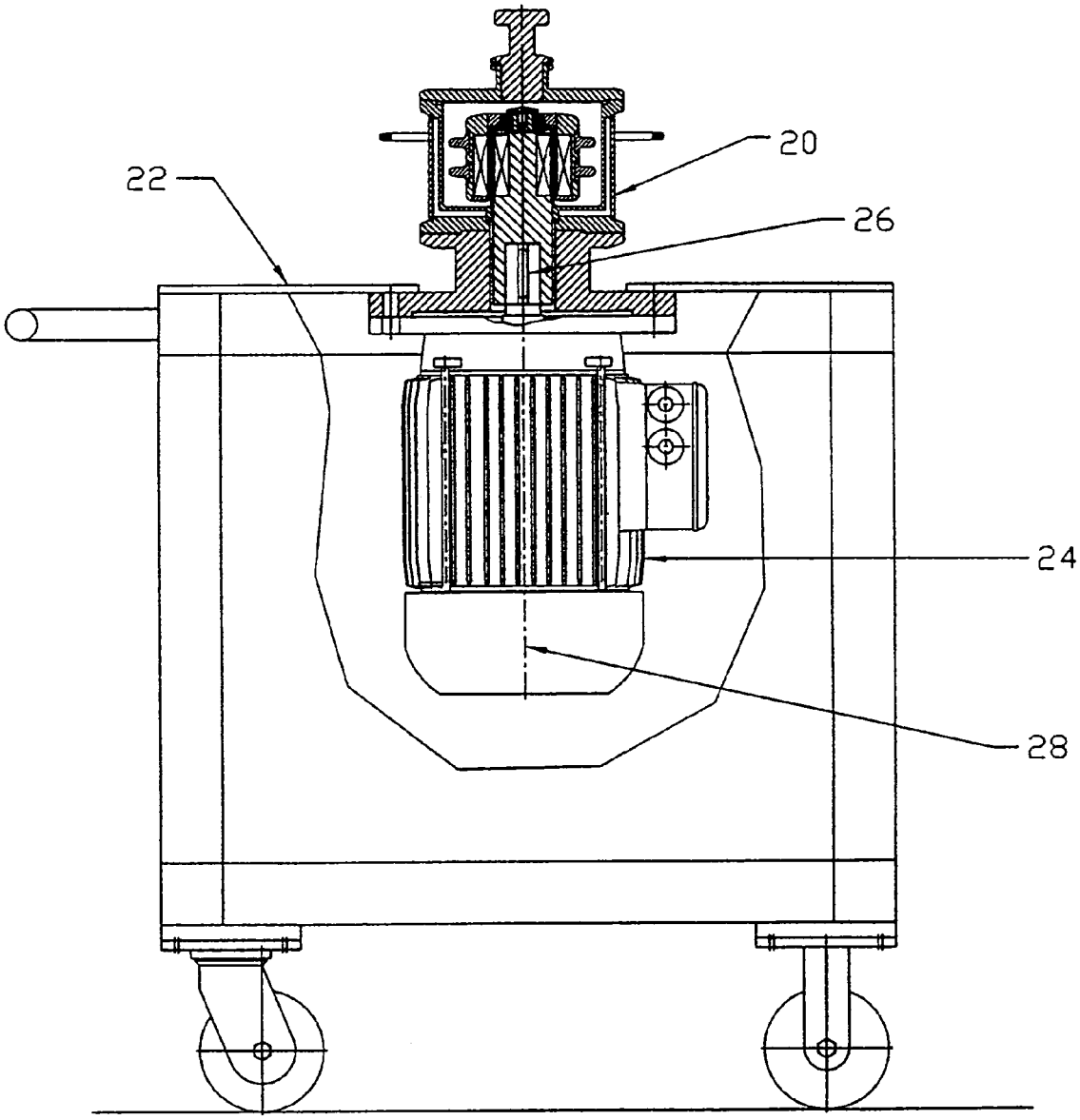
FIG. 1 is a front view, partially in section, showing a milling apparatus making use of a magnetic drive system constructed in accordance with one embodiment of this invention.

In FIG. 1 there is shown a portable milling apparatus 20 constructed in accordance with this invention. That apparatus is arranged to be used with a milling media 10 (see FIG. 2) in the form of very small spherical beads. In one embodiment of the invention, it is preferable if the milling media have a mean diameter of between 0.05 mm to 0.5 mm. The media particles can be made of various materials such as stainless steel, zirconium silicate, zirconium oxide, glass, plastics, such as cross-link polystyrene, etc. One particularly effective material is 0.2 mm cross linked polystyrene which provides a lower amount of impurities as compared to glass, ceramic or stainless steel. In the embodiment shown herein, in FIG. 2, the particles 10 are shown exaggerated in size (not to scale). The size and composition of the particles given above is merely exemplary. Thus, other milling media such as those disclosed in the two aforementioned patents incorporated by reference herein or other commercially available milling media may be used. The media 10 and the apparatus 20 together form a system making up the subject invention.

The present invention is described herein using several definitions, as set forth below and throughout the application.

As used herein, "about" will be understood by persons of ordinary skill in the art and will vary to some extent on the context in which it is used. If there are uses of the term which are not clear to persons of ordinary skill in the art given the context in which it is used, "about" will mean up to plus or minus 10% of the particular term.

"Conventional" or "non-nanoparticulate active agent" shall mean an active agent which is solubilized or which has an effective average particle size of greater than about 2 microns. Nanoparticulate active agents as defined herein have an effective average particle size of less than about 2 microns.

"Pharmaceutically acceptable" as used herein refers to those compounds, materials, compositions, and/or dosage forms which are, within the scope of sound medical judgment, suitable for use in contact with the tissues of human beings and animals without excessive toxicity, irritation, allergic response, or other problem or complication, commensurate with a reasonable benefit/risk ratio.

"Poorly water soluble drugs" as used herein means those having a solubility of less than about 30 mg/ml, preferably less than about 20 mg/ml, preferably less than about 10 mg/ml, or preferably less than about 1 mg/ml. Such drugs tend to be eliminated from the gastrointestinal tract before being absorbed into the circulation.

As used herein with reference to stable drug particles, "stable" includes, but is not limited to, one or more of the following parameters: (1) that the active agent particles do not appreciably flocculate or agglomerate due to interparticle attractive forces, or otherwise significantly increase in particle size over time; (2) that the physical structure of the active agent particles is not altered over time, such as by conversion from an amorphous phase to crystalline phase; (3) that the active agent particles are chemically stable; and/or (4) where the active agent has not been subject to a heating step at or above the melting point of the active agent in the preparation of the nanoparticles of the invention.

A. The Apparatus of the Invention

Referring now to FIG. 1, it can be seen that the apparatus 20 basically comprises a rolling cart 22 having a frame supporting an electric drive motor 24. The drive motor includes an output shaft 26 directed upward and centered on a central longitudinal axis 28. The motor's output shaft 26 is arranged to be received in a bore 30 in a cylindrical, rod-like drive shaft 32, as shown more particularly in FIG. 2. The motor includes an upper flange 34 which is arranged to be secured, such as by bolts (not shown) to a motor flange adapter 36. The motor flange adapter 36 is itself mounted below a top panel 38 of the cart via bolts (not shown).

The motor flange adapter 36 is arranged to mount thereon a milling chamber 40. The details of the milling chamber will be described later. Suffice to say that the milling chamber is a hollow vessel in which the milling media 10 is located. Also located within the milling chamber 40 is a milling head 42. The head 42 includes a plurality of pegs 44 projecting radially outward therefrom to effect agitation of the beads and the product to be milled. In this embodiment, there are four pairs of pegs 44.

The milling chamber preferably includes a cover or lid 46 to seal its interior from the ambient surroundings.

In order to couple the rotary output of the motor 24 as provided by its output shaft 26 to the agitating or milling head 42, a magnetic drive assembly, to be described hereinafter, is provided. That drive assembly basically comprises a plurality (at least one pair), e.g., 2, 4, etc., of magnets 48 located at equidistantly spaced positions around the periphery of the drive shaft 32 at the distal (upper) end thereof. The magnets 48 serve as the "drive" magnets for the system. The drive magnets are arranged to be magnetically coupled to plural "driven" magnets 50. The driven magnets 50 are preferably the same in number as the drive magnets or a multiple (e.g., 2 drive magnets and 4 driven magnets: 4 drive magnets and 8 driven magnets, etc.) and are located within the milling head 42 at equidistantly spaced locations about the longitudinal central axis of the milling head and close to the drive magnets 48 (as will be described hereinafter) so they are magnetically coupled to one another. Accordingly, rotation of the drive magnets 50 about the longitudinal axis 28 causes the concomitant rotation of the milling head 42 thereabout.

Figure 2:
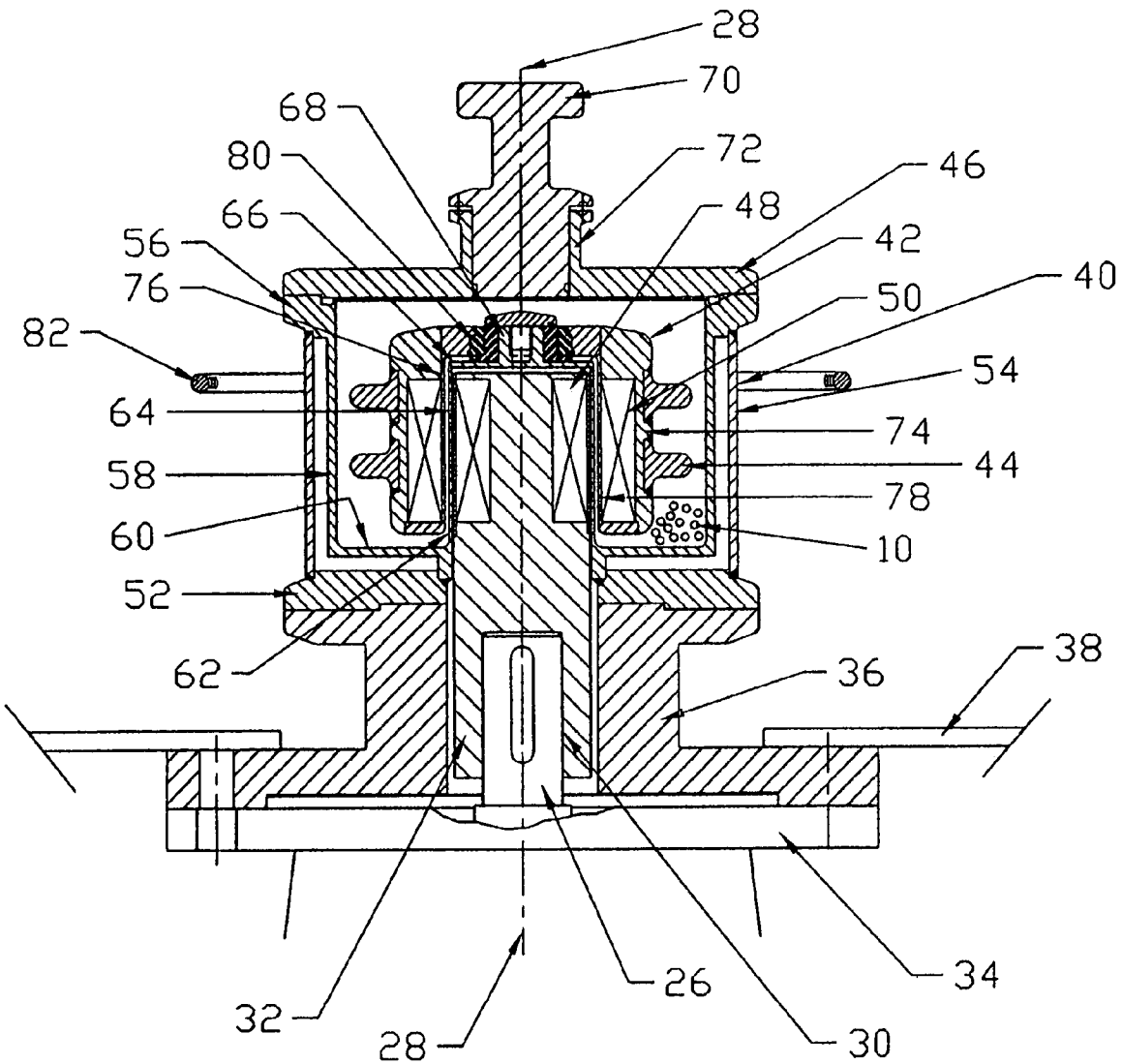
FIG. 2 is an enlarged vertical sectional view of a portion of the apparatus shown in FIG. 1.

The details of the milling chamber 40 will now be described with reference to FIG. 2. As can be seen therein, the milling chamber 40 basically comprises a planar, disc-like base plate 52 from which an outer circular cylindrical wall 54 projects. A cup-shaped member 56 is mounted on the top edge of the circular outer wall 54 and includes a circular cylindrical Inside wall 58 and an annular, planar bottom wall 60. Upstanding from the bottom wall is a hollow cylindrical spindle 62. The spindle 62 is formed by a cylindrical circular sidewall 64 and a planar top wall 66. A central hub 68 projects upward from the top wall 66 centered on the longitudinal axis. As should be appreciated from the foregoing the inner surface of the sidewall 58, the inner surface of the bottom wall 60, the outer surface of the sidewall 64 of the spindle 62, and the top surface 66 of the spindle form the Interior of the milling chamber 40 of the apparatus 20. The top of the milling chamber 401s covered by the cap 46 which is releasably secured to the flange portion of member 56. A plug 70 extends through a flanged port in the cap 46. The plug 70 is removable from the cap 46 to enable the milling media 10 and the product to be milled to be introduced into the mixing chamber 40 through the port 72.

The milling head 42 basically comprises an inverted cup-shaped member 76 having an outer sidewall 74 from which the aforementioned pegs 44 project. In particular, there are four pairs of pegs 44. The pegs 44 of each pair are disposed in a vertical array one on top of the other and the pairs themselves are disposed at equidistantly spaced positions, e.g., 900, about the periphery of the milling head sidewall 74. The central inverted cup-shaped member 76 has an inside wall 78. The plural magnets 50 are interposed in the space between the inside wall 78 and the milling head sidewall 74. The upper end of the inverted cup-shaped member includes a central passageway in which a bearing set, e.g., a pair of silicon carbide bearings 80, is located. The bearing set 80 mounts the milling head 42 on the spindle 62, with the outer surface of the spindle being spaced slightly from the outer surface of the milling head's inner wall 78.

The distal (upper) end of the drive shaft 32, that is the portion with the magnets 48, is disposed within the hollow interior or well of the spindle 62 so that the drive magnets 48 are disposed immediately adjacent the driven magnets 50 with the thin wall 64 of the spindle and the thin wall 76 of the agitating head disposed therebetween. This magnetically couples the drive and driven magnets to each other. A small air gap, e.g., 1–5 mm, separates these two walls (i.e., the outer wall of the spindle and the inner wall of the milling head) from each other.

As should be appreciated from the foregoing, the rotation of the motors output shaft 26 causes the concomitant rotation of the drive shaft 32, thereby rotating the magnets 48 at a high rate of speed, e.g., 2,000 to 3,000 rpm, about the central longitudinal axis 28. Since the "driven" magnets 50 are disposed closely adjacent to the drive magnets, the rotation of the drive magnet causes concomitant rotation of the driven magnets about that axis, thereby rotating the milling head 42 about that axis at that speed. Thus, the milling head rotates at the speed of the motor about the spindle 620 supported by the bearing set 80 while the milling chamber 40 remains stationary. The rotation of the milling head and its pegs about the central axis 28 within the stationary milling chamber mills the product down to the desired size. This is achieved by two factors, namely, impact and shear. Insofar as impact is concerned, the rotation of the pegs causes turbulence in the milling media beads 10 so that the various beads of the media collide with one another with some active agent or material (i.e., product) particles either being between the colliding beads or being impacted by such beads. In any case, the impact causes the milling of those particles, thereby reducing the particle size. In addition to the impact, the rotation of the milling head 42 causes the beads of the milling media 10 to roll along the interior surfaces of the chamber 40 and with respect to each other. This creates shear, which acts on the interdispersed product particles to further reduce the size of those particles.

In accordance with one preferred embodiment of this invention, the gap exterior of the spindle and the interior of the milling head 42 is somewhere in the range of a 6-to-I ratio of gap size to milling bead size. For example, if the milling media is 0.2 mm, the gap size can be 1.5 mm. It will be appreciated by those skilled in the art that while a bigger gap size is desirable for resistance to clogging, it is undesirable from a torque transmission standpoint, since the larger the spacing will necessitate the use of larger magnets to get a desired amount of torque to rotate the milling head.

In accordance with one preferred aspect of the invention and as a result of the magnetic drive assembly, the milling chamber 40 with the milling head therein can be removed as a unit from the apparatus 20. To that end a handle 82 is provided coupled to the chamber 40 to enable the chamber to be lifted off of the motor flange adapter 36. When that unit is lifted off the drive shaft adapter 32 exits the well in the spindle. This leaves the cart 22 of the apparatus 20 ready to receive another milling chamber 40 with a milling head 42 therein to effect the milling of some other product, while the chamber/milling head that had been used is taken to some location for filtering out the milled product from the media for subsequent use. The milling media can then be removed from that chamber and the chamber cleaned and otherwise readied for next usage.

As should be appreciated from the foregoing, the structure of the subject system avoids the use of mechanical seals or lip seats. This eliminates what is typically a very expensive component of the media mill in the case of the former and a short life component in the case of the latter. The lack of a seal in the subject invention results in an apparatus that requires less maintenance, less downtime, and lower maintenance costs. In addition, the danger of contamination by seal water or some other lubricant is eliminated. This increases the quality of the resulting product.

Other benefits of the subject system include the ease of cleaning, e.g., the mixing chamber and agitating head which are removed as a unit can be readily cleaned in a sink or washtub. Moreover, the small milling size chamber enables it to be effectively used for batch processing, e.g., the addition of the product and media via a glove box or laminar flow hood. Moreover, the system, being a "closed" one allows the product and media to be added to the milling chamber and then autoclaved to create a sterile product. Lastly, the subject apparatus enables the batch milling process to be achieved with minimum equipment parts to simplify manufacturing of small quantities of clinical test materials. Finally, the manner in which the magnets are mounted with respect to the adapter drive shaft 32 and the milling head 42 keeps the magnets from coming in contact with the product being milled.

It should be pointed out at this juncture that the milling system of this invention may include a milling head including more or less agitating pegs and which are arranged in different configurations from that discussed above. Moreover, the milling head need not make use of any pegs, but can make use of any type of member for effecting agitation/shear of the product/media located within the milling chamber. Thus, it is contemplated that the milling head can comprise a smooth walled cylindrical member without any elements projecting outward therefrom. In such an embodiment the milling operation is effected primarily, if not exclusively, by shear, whereas in the embodiment discussed above the milling operation is effected by a combination of impact and shear. Moreover, the size and shape of the various components, the number, type, and orientation of the magnets utilized, and the speed of rotation of the milling head can be modified as desired depending upon the product to be produced and other factors. For example, the size of the air gap between the spindle and the milling head can be different than that described, depending upon the size of the milling medium/media used.

It should also be pointed out that while the foregoing description of the milling apparatus has been of a vertical mill, e.g., a vertically oriented drive shaft, rotating shaft, other arrangements can be utilized as well. Thus, for example, the subject invention contemplates a horizontal mill.

B. Grinding Media

In the method of the invention, an active agent or material is prepared in the form of particles by grinding the agent or material in the presence of a grinding media.

The grinding media for the particle size reduction step can be selected from rigid media preferably spherical or particulate in shape, e.g., beads. However, grinding media in the form of other non-spherical shapes are expected to be useful in the practice of this invention.

The grinding media preferably can have a mean particle size up to about 500 microns. In other embodiments of the invention, the grinding media particles have a mean particle size preferably less than about 500 microns, less than about 100 microns, less than about 75 microns, less than about 50 microns, less than about 25 microns, less than about 5 microns, less than about 3 mm, less than about 2 mm, less than about 1 mm, less than about 0.25 mm, or less than about 0.2 mm. For fine grinding, the grinding media particles preferably are from about 0.2 to about 2 mm, more preferably, about 0.25 to about 1 mm in size. Such media desirably can provide the particles of the invention with shorter processing times and impart less wear to the milling equipment.

The selection of material for the grinding media is not believed to be critical. However, media with higher density, e.g., glass (2.6 g/cm$^3$), zirconium silicate (3.7 g/cm$^3$), and zirconium oxide (5.4 g/cm$^3$), are generally preferred for more efficient milling. Zirconium oxide, such as 95% ZrO stabilized with magnesia, zirconium silicate, and glass grinding media provide particles having levels of contamination which are believed to be acceptable for the preparation of therapeutic or diagnostic compositions. However, other media, such as stainless steel, titania, alumina, and 95% ZrO stabilized with yttrium, are believed to be useful. In addition, polymeric media having a density typically from about 1 to about 2 g/cm$^3$ are also expected to be useful.

If polymeric grinding media is utilized, then the grinding media can comprise particles consisting essentially of the polymeric resin. Alternatively, the grinding media can comprise particles comprising a core having a coating of the polymeric resin adhered thereon. The polymeric resin preferably has a density from 0.8 to 3.0 g/cm$^3$. Higher density resins are preferred inasmuch as it is believed that these provide more efficient particle size reduction.

In general, polymeric resins suitable for use herein are chemically and physically inert, substantially free of metals, solvent and monomers, and of sufficient hardness and friability to enable them to avoid being chipped or crushed during grinding. Suitable polymeric resins include but are not limited to crosslinked polystyrenes, such as polystyrene crosslinked with divinylbenzene, styrene copolymers, polycarbonates, polyacetals, such as Delrin™, vinyl chloride polymers and copolymers, polyurethanes, polyamides, poly (tetrafluoroethylenes), e.g., Teflon™, and other fluoropolymers, high density polyethylenes, polypropylenes, cellulose ethers and esters such as cellulose acetate, polyhydroxymethacrylate, polyhydroxyethyl acrylate, silicone containing polymers such as polysiloxanes, and the like. The polymeric polymer can be biodegradable. Exemplary biodegradable polymeric polymers include poly(lactides), poly (glycolide) copolymers of lactides and glycolide, polyanhydrides, poly(hydroxyethyl methacylate), poly(imino carbonates), poly(N-acylhydroxyproline)esters, poly(N-palmitoyl hydroxyproline) esters, ethylene-vinyl acetate copolymers, poly(orthoesters), poly(caprolactones), and poly(phosphazenes). In the case of biodegradable polymers, contamination from the media itself advantageously can metabolize in vivo into biologically acceptable products which can be eliminated from the body.

The core material preferably can be selected from materials known to be useful as grinding media when fabricated as spheres or particles. Suitable core materials include but are not limited to zirconium oxides (such as 95% zirconium oxide stabilized with magnesia or yttrium), zirconium silicate, glass, stainless steel, titania, alumina, ferrite, and the like. Preferred core materials have a density greater than about 2.5 g/cm$^3$. The selection of high density core materials is believed to facilitate efficient particle size reduction.

Useful thicknesses of the polymeric polymer coating on the core are believed to range from about 1 to about 500 microns, although other thicknesses outside this range may be useful in some applications. The thickness of the polymer coating preferably is less than the diameter of the core.

The cores can be coated with the polymeric resin by techniques known in the art. Suitable techniques include spray coating, fluidized bed coating, and melt coating. Adhesion promoting or tie layers can optionally be provided to improve the adhesion between the core material and the resin coating. The adhesion of the polymer coating to the core material can be enhanced by treating the core material to adhesion promoting procedures, such as roughening of the core surface, corona discharge treatment, and the like.

C. Materials to be Milled

It is further appreciated that the present invention may be used to produce a number of therapeutic or diagnostic agents, collectively referred to as a "drug." The drug is typically present in an essentially pure form, is poorly soluble, and is dispersible in at least one liquid medium. By "poorly soluble" it is meant that the drug has a solubility in the liquid dispersion medium of less than about 30 mg/mL, less than about 20 mg/mL, less than about 10 mg/mL, and preferably of less than about 1 mg/mL. Useful liquid dispersion medias include, but are not limited to, water, aqueous salt solutions, safflower oil, and solvents such as ethanol, t-butanol, hexane, and glycol. A preferred liquid dispersion media is water. Two or more active agents can be used in combination.

The active agent exists as a crystalline phase, an amorphous phase, a semi-amorphous phase, a semi-crystalline phase, or mixtures thereof. The crystalline phase differs from a non-crystalline or amorphous phase which results from precipitation techniques, such as those described in EP Patent No. 275,796.

A therapeutic agent can be a pharmaceutical, including biologics such as proteins and peptides, and a diagnostic agent is typically a contrast agent, such as an x-ray contrast agent, or any other type of diagnostic material. In one embodiment, the drug exists as a discrete, crystalline phase.

The crystalline phase differs from a non-crystalline or amorphous phase which results from precipitation techniques, such as those described in EP Patent No. 275,796.

The term "drug" used herein includes, but is not limited to, peptides or proteins (and mimetics thereof), antigens, vaccines, hormones, analgesics, anti-migraine agents, anticoagulant agents, medications directed to the treatment of diseases and conditions of the central nervous system, narcotic antagonists, immunosuppressants, agents used in the treatment of AIDS, chelating agents, anti-anginal agents, chemotherapy agents, sedatives, anti-neoplastics, prostaglandins, antidiuretic agents and DNA or DNNRNA molecules to support gene therapy.

Typical drugs include nutraceuticals, peptides, proteins or hormones (or any mimetic or analogues of any thereof) including, but not limited to, insulin, calcitonin, calcitonin gene regulating protein, atrial natriuretic protein, betaserori, erythropoietin (EPO), interferons including, but not limited to, alpha, beta, and gamma-interferon, somatropin, somatotropin, somastostatin, insulin-like growth factor (somatomedins), luteinizing hormone releasing hormone (LHRH), factor VIII, interleukins including, but not limited to, interleukin-2, and analogues or antagonists thereof, including, but not limited to, IL-1ra, thereof; hematological agents including, but not limited to, anticoagulants including, but not limited to, heparin, hirudin and analogues thereof, hematopoietic agents including, but not limited to, colony stimulating factors, hemostatics, thrombolytic agents including, but not limited to, tissue plasminogen activator (TPA); endocrine agents including, but not limited to, antidiabetic agents, antithyroid agents, beta-adrenoceptor blocking agents, growth hormones, growth hormone releasing hormone (GHRH), sex hormones including, but not limited to, estradiol, thyroid agents, parathyroid calcitonin, biphosphonates, uterine-active agents including, but not limited to, oxytocin and analogues thereof; cardiovascular agents including, but not limited to, antiarrhythmic agents, anti-anginal agents including, but not limited to, nitroglycerine, and analogues thereof, anti-hypertensive agents and vasodilators including, but not limited to, diltiazem, clonidine, nifedipine, verapamil, isosorbide-5-mononitrate, organic nitrates, agents used in treatment of heart disorders, and analogues thereof, cardiac inotropic agents; renal and genitounnary agents including, but not limited to, diuretics; antidiuretic agents including, but not limited to, desmopressin, vasopressin, and analogues thereof; respiratory agents including, but not limited to, antihistamines, cough suppressants including, but not limited to, expectorants and mucolytics, parasympathomimetics, sympathomimetics, xanthines and analogues thereof; central nervous system agents including, but not limited to, analgesics including, but not limited to, fentanyl, sufentanil, butorphanol, buprenorphine, levorphanol, morphine, hydromorphone, hydrocodone, oxymorphone, methadone, lidocaine, bupivacaine, diclofenac, naproxen, paverin, and analogues thereof, anesthetics, anti-emetic agents including, but not limited to, scopolamine, ondansetron, domperidone, metoclopramide, and analogues thereof, anorexiants, antidepressants, anti-migraine agents including, but not limited to, sumatriptan, ergot alkaloids, and analogues thereof, antiepileptics, dopaminergics, anticholinergics, antiparkinsonian agents, muscle relaxants, narcotic antagonists, sedatives including, but not limited to, benzodiazepines, phenothiozines, and analogues thereof, stimulants, treatments for attention deficit disorder, methylphenidate, fluoxamine, bisolperol, tactolimuls, sacrolimus and cyclosporin and analogues thereof, gastrointestinal agents including, but not limited to, prostaglandins and analogues thereof; systemic anti-infectives including, but not limited to, antibiotics, antiviral agents, anti-flingals, agents used in the treatment of AIDS, anthelmintics, antimycobacterial agents; biologic and immunologic agents including, but not limited to, immunosuppressants, vaccines, hormones; dermatological agents including, but not limited to, anti-allergic agents, astringents, anti-inflammatory agents including, but not limited to, corticosteroids, elastase inhibitors, antimuscarinic agents, lipid regulating agents, blood products and substitutes; antineoplastic agents including, but not limited to, fluorouracil, bleomycin, and analogues thereof, leuprolide acetate, chemotherapy agents including, but not limited to, vincristine, and analogues thereof, oncology therapies; diagnostic aids including, but not limited to, diagnostic agents, diagnostic imaging agents, radio-pharmaceuticals, contrast media including, but not limited to, an x-ray contrast agent; nutrients and nutritional agents including, but not limited to, chelating agents including, but not limited to, deferoxamine, and analogues thereof.

Exemplary nutraceuticals and dietary supplements are disclosed, for example, in Roberts et al., *Nutraceuticals: The Complete Encyclopedia of Supplements, Herbs, Vitamins, and Healing Foods* (American Nutraceutical Association, 2001), which is specifically incorporated by reference. A nutraceutical or dietary supplement, also known as phytochemicals or functional foods, is generally any one of a class of dietary supplements, vitamins, minerals, herbs, or healing foods that have medical or pharmaceutical effects on the body. Exemplary nutraceuticals or dietary supplements include, but are not limited to, lutein, folic acid, fatty acids (e.g., DHA and ARA), fruit and vegetable extracts, vitamin and mineral supplements, phosphatidylserine, lipoic acid, melatonin, glucosamine/chondroitin, Aloe Vera, Guggul, glutamine, amino acids (e.g., iso-leucine, leucine, lysine, methionine, phenylanine, threonine, tryptophan, and valine), green tea, lycopene, whole foods, food additives, herbs, phytonutrients, antioxidants, flavonoid constituents of fruits, evening primrose oil, flax seeds, fish and marine animal oils, and probiotics. Nutraceuticals and dietary supplements also include bio-engineered foods genetically engineered to have a desired property, also known as "pharmafoods."

A description of these classes of drugs and a listing of species within each class can be found in Martindale, *The Extra Pharmacopoeia*, Twenty-ninth Edition (The Pharmaceutical Press, London, 1989), specifically incorporated by reference. The drugs are commercially available and/or can be prepared by techniques known in the art.

D. Particle Size of the Milled Active Agent

The milled materials of the invention can have an effective average particle size of less than about 2000 nm (i.e., 2 microns). In other embodiments of the invention, the milled materials have an effective average particle size of less than about 1900 nm, less than about 1800 nm, less than about 1700 nm, less than about 1600 nm, less than about 1500 nm, less than about 1400 nm, less than about 1300 nm, less than about 1200 nm, less than about 1100 nm, less than about 1000 nm, less than about 900 nm, less than about 800 nm, less than about 700 nm, less than about 600 nm, less than about 500 nm, less than about 400 nm, less than about 300 nm, less than about 250 nm, less than about 200 nm, less than about 150 nm, less than about 100 nm, less than about 75 nm, or less than about 50 nm, as measured by light-scattering methods, microscopy, or other appropriate methods.

By "an effective average particle size of less than about 2000 nm" it is meant that at least 50% by weight of the milled material particles have a particle size less than the effective average, i.e., less than about 2000 nm, 1900 nm, 1800 nm, etc., when measured by the above-noted techniques. In other embodiments of the invention, at least about 70%, at least about 90%, at least about 95%, or at least about 99% of the milled material particles have a particle size less than the effective average, i.e., less than about 2000 nm, 1900 nm, 1800 nm, etc.

E. Surface Stabilizers

If the material is milled to an effective average particle size of less than about 2 microns, then preferably the material is milled in the presence of at least one surface stabilizer. Alternatively, at least one surface stabilizer can be added to the milled material composition following milling.

The surface stabilizers of the invention are preferably adsorbed on, or associated with, the surface of the active agent or material particles. The surface stabilizers especially useful herein preferably do not chemically react with the active agent particles or itself. Preferably, individual molecules of the surface stabilizer are essentially free of intermolecular cross-linkages. Two or more surface stabilizers can be employed in the compositions and methods of the invention.

Suitable surface stabilizers can preferably be selected from known organic and inorganic pharmaceutical excipients. Such excipients include various polymers, low molecular weight oligomers, natural products, and surfactants. Preferred surface stabilizers include nonionic, anionic, cationic, zwitterionic, and ionic surfactants.

Representative examples of surface stabilizers include gelatin, casein, lecithin (phosphatides), dextran, gum acacia, cholesterol, tragacanth, stearic acid, benzalkonium chloride, calcium stearate, glycerol monostearate, cetostearyl alcohol, cetomacrogol emulsifying wax, sorbitan esters, polyoxyethylene alkyl ethers (e.g., macrogol ethers such as cetomacrogol 1000), polyoxyethylene castor oil derivatives, polyoxyethylene sorbitan fatty acid esters (e.g., the commercially available Tweens® such as e.g., Tween 20® and Tween 80® (ICI Speciality Chemicals)); polyethylene glycols (e.g., Carbowaxs 3550® and 934® (Union Carbide)), polyoxyethylene stearates, colloidal silicon dioxide, phosphates, sodium dodecylsulfate, carboxymethylcellulose calcium, carboxymethylcellulose sodium, methylcellulose, hydroxyethylcellulose, hydroxypropyl celluloses (e.g., HPC, HPC-SL, and HPC-L), hydroxypropyl methylcellulose (HPMC), hydroxypropylmethyl-cellulose phthalate, noncrystalline cellulose, magnesium aluminum silicate, triethanolamine, polyvinyl alcohol (PVA), polyvinylpyrrolidone (PVP), 4-(1,1,3,3-tetramethylbutyl)-phenol polymer with ethylene oxide and formaldehyde (also known as tyloxapol, superione, and triton), poloxamers (e.g., Pluronics F68® and F108®, which are block copolymers of ethylene oxide and propylene oxide); poloxamines (e.g., Tetronic 908®, also known as Poloxamine 908®, which is a tetrafunctional block copolymer derived from sequential addition of propylene oxide and ethylene oxide to ethylenediamine (BASF Wyandotte Corporation, Parsippany, N.J.)); Tetronic 1508® (T-1508) (BASF Wyandotte Corporation), dialkylesters of sodium sulfosuccinic acid (e.g., Aerosol OT®, which is a dioctyl ester of sodium sulfosuccinic acid (DOSS) (American Cyanamid)); Duponol P®, which is a sodium lauryl sulfate (DuPont); Tritons X-200®, which is an alkyl aryl polyether sulfonate (Rohm and Haas); Crodestas F-110®, which is a mixture of sucrose stearate and sucrose distearate (Croda Inc.); p-isononylphenoxypoly-(glycidol), also known as Olin-1OG® or Surfactant 10-G® (Olin Chemicals, Stamford, Conn.); Crodestas SL-40® (Croda, Inc.); and SA9OHCO, which is $C_{18}H_{37}CH_2C(O)N(CH_3)$—$CH_2(CHOH)_4(CH_2OH)_2$ (Eastman Kodak Co.); decanoyl-N-methylglucamide; n-decyl β-D-glucopyranoside; n-decyl β-D-maltopyranoside; n-dodecyl β-D-glucopyranoside; n-dodecyl β-D-maltoside; heptanoyl-N-methylglucamide; n-heptyl-β-D-glucopyranoside; n-heptyl β-D-thioglucoside; n-hexyl β-D-glucopyranoside; nonanoyl-N-methylglucamide; n-noyl β-D-glucopyranoside; octanoyl-N-methylglucamide; n-octyl-β-D-glucopyranoside; octyl β-D-thioglucopyranoside; lysozyme, PEG-derivatized phospholipid, PEG-derivatized cholesterol, PEG-derivatized cholesterol derivative, PEG-derivatized vitamin A, PEG-derivatized vitamin E, random copolymers of vinyl pyrrolidone and vinyl acetate, and the like.

Examples of useful cationic surface stabilizers include but are not limited to polymers, biopolymers, polysaccharides, cellulosics, alginates, phospholipids, and nonpolymeric compounds, such as zwitterionic stabilizers, poly-n-methylpyridinium, anthryul pyridinium chloride, cationic phospholipids, a charged phospholipid such as dimyristoyl phophatidyl glycerol, chitosan, polylysine, polyvinylimidazole, polybrene, polymethylmethacrylate trimethylammoniumbromide bromide (PMMTMABr), hexyldesyltrimethylammonium bromide (HDMAB), and polyvinylpyrrolidone-2-dimethylaminoethyl methacrylate dimethyl sulfate.

Other useful cationic stabilizers include, but are not limited to, cationic lipids, sulfonium, phosphonium, and quarternary ammonium compounds, such as stearyltrimethylammonium chloride, benzyl-di(2-chloroethyl)ethylammonium bromide, coconut trimethyl ammonium chloride or bromide, coconut methyl dihydroxyethyl ammonium chloride or bromide, dodecyl trimethyl ammonium bromide, decyl triethyl ammonium chloride, decyl dimethyl hydroxyethyl ammonium chloride or bromide, $C_{12-15}$dimethyl hydroxyethyl ammonium chloride or bromide, coconut dimethyl hydroxyethyl ammonium chloride or bromide, myristyl trimethyl ammonium methyl sulphate, lauryl dimethyl benzyl ammonium chloride or bromide, lauryl dimethyl $(ethenoxy)_4$ ammonium chloride or bromide, N-alkyl($C_{12-18}$)dimethylbenzyl ammonium chloride, N-alkyl($C_{14-18}$) dimethyl-benzyl ammonium chloride, N-tetradecylidmethylbenzyl ammonium chloride monohydrate, dimethyl didecyl ammonium chloride, N-alkyl and ($C_{12-14}$)dimethyl 1-napthylmethyl ammonium chloride, trimethylammonium halide, alkyl-trimethylammonium salts and dialkyl-dimethylammonium salts, lauryl trimethyl ammonium chloride, ethoxylated alkyamidoalkyldialkylammonium salt and/or an ethoxylated trialkyl ammonium salt, dialkylbenzene dialkylammonium chloride, N-didecyldimethyl ammonium chloride, N-tetradecyldimethylbenzyl ammonium, chloride monohydrate, N-alkyl($C_{12-14}$)dimethyl 1-naphthylmethyl ammonium chloride and dodecyldimethylbenzyl ammonium chloride, dialkyl benzenealkyl ammonium chloride, lauryl trimethyl ammonium chloride, alkylbenzyl methyl ammonium chloride, alkyl benzyl dimethyl ammonium bromide, $C_{12}$, $C_{15}$, $C_{17}$ trimethyl ammonium bromides, dodecylbenzyl triethyl ammonium chloride, polydiallyldimethylammonium chloride (DADMAC), dimethyl ammonium chlorides, alkyldimethylammonium halogenides, tricetyl methyl ammonium chloride, decyltrimethylammonium bromide, dodecyltriethylammonium bromide, tetradecyltrimethylammonium bromide, methyl trioctylammonium chloride (ALIQUAT 336™), POLYQUAT 10™, tetrabutylammonium bromide, benzyl trimethylammonium bromide, choline esters (such as choline esters of fatty acids), benzalkonium chloride, stearalkonium chloride compounds (such as stearyltrimonium chloride and Di-stearyldimonium chloride), cetyl pyridinium bromide or chloride, halide salts of quaternized polyoxyethylalkylamines, MIRAPOL™ and ALKAQUAT™ (Alkaril Chemical Company), alkyl pyridinium salts; amines, such as alkylamines, dialkylamines, alkanolamines, polyethylenepolyamines, N,N-dialkylaminoalkyl acrylates, and vinyl pyridine, amine salts, such as lauryl amine acetate, stearyl amine acetate, alkylpyridinium salt, and alkylimidazolium salt, and amine oxides; imide azolinium salts; protonated quaternary acrylamides; methylated quaternary polymers, such as poly [diallyl dimethylammonium chloride] and poly-[N-methyl vinyl pyridinium chloride]; and cationic guar.

Such exemplary cationic surface stabilizers and other useful cationic surface stabilizers are described in J. Cross and E. Singer, *Cationic Surfactants: Analytical and Biological Evaluation* (Marcel Dekker, 1994); P. and D. Rubingh (Editor), *Cationic Surfactants: Physical Chemistry* (Marcel Dekker, 1991); and J. Richmond, *Cationic Surfactants: Organic Chemistry*, (Marcel Dekker, 1990).

Particularly preferred cationic stabilizers are any non-polymeric compound, such benzalkonium chloride, a carbonium compound, a phosphonium compound, an oxonium compound, a halonium compound, a cationic organometallic compound, a quartemary phosphorous compound, a pyridinium compound, an anilinium compound, an immonium compound, a hydroxylammonium compound, a primary ammonium compound, a secondary ammonium compound, a tertiary ammonium compound, and quarternary ammonium compounds of the formula $NR_1R_2R_3R_4^{(+)}$. For compounds of the formula $NR_1R_2R_3R_4^{(+)}$.

(i) none of $R_1$–$R_4$ are $CH_3$;

(ii) one of $R_1$–$R_4$ is $CH_3$;

(iii) three of $R_1$–$R_4$ are $CH_3$;

(iv) all of $R_1$–$R_4$ are $CH_3$;

(v) two of $R_1$–$R_4$ are $CH_3$, one of $R_1$–$R_4$ is $C_6H_5CH_2$, and one of $R_1$–$R_4$ is an alkyl chain of seven carbon atoms or less;

(vi) two of $R_1$–$R_4$ are $CH_3$, one of $R_1$–$R_4$ is $C_6H_5CH_2$, and one of $R_1$–$R_4$ is an alkyl chain of nineteen carbon atoms or more;

(vii) two of $R_1$–$R_4$ are $CH_3$ and one of $R_1$–$R_4$ is the group $C_6H_5(CH_2)_n$, where n>1;

(viii) two of $R_1$–$R_4$ are $CH_3$, one of $R_1$–$R_4$ is $C_6H_5CH_2$, and one of $R_1$–$R_4$ compries at least one heteroatom;

(ix) two of $R_1$–$R_4$ are $CH_3$, one of $R_1$–$R_4$ is $C_6H_5CH_2$, and one of $R_1$–$R_4$ compries at least one halogen;

(x) two of $R_1$–$R_4$ are $CH_3$, one of $R_1$–$R_4$ is $C_6H_5CH_2$, and one of $R_1$–$R_4$ compries at least one cyclic fragment;

(xi) two of $R_1$–$R_4$ are $CH_3$ and one of $R_1$–$R_4$ is a phenyl ring; or (xii) two of $R_1$–$R_4$ are $CH_3$ and two of $R_1$–$R_4$ are purely aliphatic fragments.

Such compounds include, but are not limited to, behenalkonium chloride, benzethonium chloride, cetylpyridinium chloride, behentrimonium chloride, lauralkonium chloride, cetalkonium chloride, cetrimonium bromide, cetrimonium chloride, cethylamine hydrofluoride, chlorallylmethenamine chloride (Quaternium-15), distearyldimonium chloride (Quaternium-5), dodecyl dimethyl ethylbenzyl ammonium chloride(Quaternium-14), Quaternium-22, Quaternium-26, Quaternium-18 hectorite, dimethylaminoethylchloride hydrochloride, cysteine hydrochloride, diethanolammonium POE (10) oletyl ether phosphate, diethanolammonium POE (3)oleyl ether phosphate, tallow alkonium chloride, dimethyl dioctadecylammoniumbentonite, stearalkonium chloride, domiphen bromide, denatonium benzoate, myristalkonium chloride, laurtrimonium chloride, ethylenediamine dihydrochloride, guanidine hydrochloride, pyridoxine HCl, iofetamine hydrochloride, meglumine hydrochloride, methylbenzethonium chloride, myrtrimonium bromide, oleyltrimonium chloride, polyquaternium-1, procainehydrochloride, cocobetaine, stearalkonium bentonite, stearalkoniumhectonite, stearyl trihydroxyethyl propylenediamine dihydrofluoride, tallowtrimonium chloride, and hexadecyltrimethyl ammonium bromide.

Most of these surface stabilizers are known pharmaceutical excipients and are described in detail in the *Handbook of Pharmaceutical Excipients*, published jointly by the American Pharmaceutical Association and The Pharmaceutical Society of Great Britain (The Pharmaceutical Press, 1986), specifically incorporated by reference. The surface stabilizers are commercially available and/or can be prepared by techniques known in the art.

F. Concentration of Active Agent and Surface Stabilizer

The relative amounts of active agent and surface stabilizer can vary widely. The optimal amount of the individual components can depend, for example, upon the particular active agent selected, the particular surface stabilizer selected, and the hydrophilic lipophilic balance (HLB), melting point, and the surface tension of water solutions of the surface stabilizer, etc.

The concentration of the surface stabilizer can vary from about 0.5% to about 99.999%, from about 5.0% to about 99.9%, or from about 10% to about 99.5%, by weight, based on the total combined dry weight of the at least one active agent and at least one surface stabilizer, not including other excipients.

The concentration of the at least one active agent can vary from about 99.5% to about 0.001%, from about 95% to about 0.1%, or from about 90% to about 0.5%, by weight, based on the total combined dry weight of the active agent and at least one surface stabilizer, not including other excipients.

G. Milling Methods

The milling process can be a dry process, e.g., a dry roller milling process, or a wet process, i.e., wet-grinding. In preferred embodiments, this invention is practiced in accordance with the wet-grinding process described in U.S. Pat. No. 5,145,684. Thus, the wet grinding process can be practiced in conjunction with a liquid dispersion medium and at least one surface stabilizer.

In preferred embodiments, the active agent can be prepared in submicron or nanoparticulate particle size, e.g., less than about 2000 nm. As described above, smaller particle sizes can also be obtained using the apparatus and method of the invention. It was particularly surprising and unexpected that such fine particles could be prepared free of unacceptable contamination using the system and method of the invention.

The preferred proportions of the grinding media, the active agent, the optional liquid dispersion medium, and surface stabilizer present in the grinding vessel can vary within wide limits and depends, for example, upon the particular active agent selected, the size and density of the grinding media, the particular surface stabilizer selected, etc.

The milling process can be carried out in a continuous, batch, or semi-batch mode.

The attrition time can vary widely and depends primarily upon the particular active agent, mechanical means and residence conditions selected, the initial and desired final particle size and so forth. Typical milling times can vary from less than about 30 minutes to several days.

After attrition is completed, the grinding media is separated from the milled particulate product (in either a dry or liquid dispersion form) using conventional separation techniques, such as by filtration, sieving through a mesh screen, and the like.

While the invention has been described in detail and with reference to specific examples thereof, it will be apparent to one skilled in the art that various changes and modifications can be made therein without departing from the spirit and scope thereof. Thus, it is intended that the present invention cover the modifications and variations of this invention provided they come within the scope of the appended claims and their equivalents.

We claim:

1. A system for milling at least one material, said system comprising a milling apparatus, said apparatus comprising:

(a) a milling chamber, said milling chamber comprising a hollow vessel for receipt of the at least one material; and (b) a drive member, said drive member including at least one drive magnet, and said drive member being arranged to be rotated by an energy source, (c) a milling head, said milling head being located within said milling chamber, being rotatably mounted with respect thereto, and including at least one driven magnet, said at least one drive magnet being magnetically coupled to said at least one driven magnet;

whereupon rotation of said drive member effects the concomitant rotation of said milling head with respect to said milling chamber, to effect the milling of the at least one material within said milling chamber.

2. The system of claim 1, wherein said drive member comprises a drive shaft having a first end portion and a longitudinal axis, wherein:

(a) the at least one drive magnet is coupled to said drive shaft at said first end portion, (b) the milling head has a central bore in which a portion of said milling chamber is located but spaced slightly therefrom, (c) the at least one driven magnet is located adjacent to said central bore, and (d) the drive shaft is arranged to be rotated about said longitudinal axis by the energy source, whereupon rotation of said drive shaft about said longitudinal axis effects the concomitant rotation of said milling head about said longitudinal axis.

3. The system of claim 2, wherein said portion of said milling chamber comprises a spindle having a central well therein.

4. The system of claim 3, wherein:

(a) said first end portion of said drive shaft is located within said central well; and (b) said at least one drive magnet is magnetically coupled to said at least one driven magnet via said spindle.

5. The system of claim 1, further comprising at least one milling media for use therewith, wherein the milling media cooperates with said milling head to effect the milling of the at least one material within said milling chamber.

6. The system of claim 5, wherein said milling media comprise a plurality of small bodies.

7. The system of claim 6, wherein said small bodies have a particle size selected from the group consisting of less than about 500 microns, less than about 100 microns, less than about 75 microns, less than about 50 microns, less than about 25 microns, less than about 5 microns, less than about 3 mm, less than about 2 mm, less than about 1 mm, less than about 0.25 mm, and less than about 0.2 mm.

8. The system of claim 5, wherein said at least one milling media comprise a polymeric material.

9. The system of claim 1, wherein said milling chamber is removably mounted with respect to said drive member, whereupon said milling chamber and said milling head can be removed as a unit from said drive member.

10. The system of claim 9, wherein said milling head comprises a plurality of pegs projecting outward therefrom.

11. The system of claim 1, wherein said milling chamber includes a removable cover.

12. The system of claim 1, wherein said drive member is a shaft that is oriented vertically and is rotated by a motor.

13. The system of claim 1, wherein said milling head includes at least one member projecting outward therefrom to effect the milling of the at least one material within said milling chamber.

14. The system of claim 1 additionally comprising at least one bearing rotatably mounting said milling head within said milling chamber.

15. The system of claim 1, wherein said at least one drive magnet is a rare earth magnet.

16. The system of claim 1, wherein said at least one driven magnet is a rare earth magnet.

17. The system of claim 1, wherein the material exists as a crystalline phase, an amorphous phase, a semi-amorphous phase, a semi-crystalline phase, or a mixture thereof.

18. The system of claim 1, wherein the material is a drug.

19. The system of claim 18, wherein the drug is poorly soluble and is dispersible in at least one liquid medium.

20. The system of claim 19, wherein the liquid medium is selected from the group consisting of water, aqueous salt solutions, safflower oil, ethanol, t-butanol, hexane, and glycol.

21. The system of claim 18, wherein the drug is selected from the group consisting of peptides, proteins, peptide mimetics, antigens, vaccines, hormones, analgesics, anti-migraine agents, anti-coagulant agents, medications directed to the treatment of diseases and conditions of the central nervous system, narcotic antagonists, immunosuppressants, agents used in the treatment of AIDS, chelating agents, anti-anginal agents, chemotherapy agents, sedatives, anti-neoplastics, prostaglandins, antidiuretic agents, DNA molecules to support gene therapy, and DNNRNA molecules to support gene therapy.

22. The system of claim 18, wherein the drug is selected from the group consisting of insulin, calcitonin, calcitonin gene regulating protein, atrial natriuretic protein, betaserori, erythropoietin, alpha interferon, beta interferon, gamma interferon, somatropin, somatotropin, somastostatin, insulin-like growth factor, luteinizing hormone releasing hormone, factor VIII, interleukins, interleukin analogues, hematological agents, anticoagulants, hematopoietic agents, hemostatics, thrombolytic agents, endocrine agents, antidiabetic agents, antithyroid agents, beta-adrenoceptor blocking agents, growth hormones, growth hormone releasing hormone, sex hormones, thyroid agents, parathyroid calcitonin, biphosphonates, uterine-active agents, cardiovascular agents, antiarrhythmic agents, anti-anginal agents, anti-hypertensive agents, vasodilators, agents used in treatment of heart disorders, cardiac inotropic agents, renal agents, genitounnary agents, antidiuretic agents, respiratory agents, antihistamines, cough suppressants, parasympathomimetics, sympathomimetics, xanthines, central nervous system agents, analgesics, anesthetics, anti-emetic agents, anorexiants, antidepressants, anti-migraine agents, antiepileptics, dopaminergics, anticholinergics, antiparkinsonian agents, muscle relaxants, narcotic antagonists, sedatives, stimulants, treatments for attention deficit disorder, methylphenidate, fluoxamine, bisolperol, tactolimuls, sacrolimus, cyclosporine, gastrointestinal agents, systemic anti-infectives, agents used in the treatment of AIDS, anthelmintics, antimycobacterial agents, immunologic agents, vaccines, hormones; dermatological agents including, anti-inflammatory agents, elastase inhibitors, antimuscarinic agents, lipid regulating agents, blood products, blood substitutes, antineoplastic agents including, leuprolide acetate, chemotherapy agents, oncology therapies, nutrients, nutritional agents, chelating agents.

23. The system of claim 22, wherein the drug is selected from the group consisting of interleukin-2, IL-1ra, heparin, hirudin, colony stimulating factors, tissue plasminogen activator, estradiol, oxytocin, nitroglycerine, diltiazem, clonidine, nifedipine, verapamil, isosorbide-5-mononitrate, organic nitrates, diuretics, desmopressin, vasopressin, expectorants, mucolytics, fentanyl, sufentanil, butorphanol, buprenorphine, levorphanol, morphine, hydromorphone, hydrocodone, oxymorphone, methadone, lidocaine, bupivacaine, diclofenac, naproxen, paverin, scopolamine, ondansetron, domperidone, metoclopramide, sumatriptan, ergot alkaloids, benzodiazepines, phenothiozines, prostaglandins antibiotics, antiviral agents, anti-fungals, immunosuppressants, anti-allergic agents, astringents, corticosteroids fluorouracil, bleomycin, vincristine, and deferoxamine.

24. The system of claim 1, wherein the material is a diagnostic aid.

25. The system of claim 24, wherein the diagnostic aid is selected from the group consisting of diagnostic agents, diagnostic imaging agents, radio-pharmaceuticals, and contrast media.

26. The system of claim 1, wherein the material is milled in the presence of at least one surface stabilizer.

27. The system of claim 26, wherein the material is milled in the presence of at least two surface stabilizers.

28. The system of claim 26, wherein the surface stabilizer is selected from the group consisting of a nonionic surfactant, an anionic surfactant, a cationic surfactant, a zwitterionic surfactant, and an ionic surfactant.

29. The system of claim 26, wherein the surface stabilizer is selected from the group consisting of gelatin, casein, lecithin, dextran, gum acacia, cholesterol, tragacanth, stearic acid, benzalkonium chloride, calcium stearate, glycerol monostearate, cetostearyl alcohol, cetomacrogol emulsifying wax, sorbitan esters, polyoxyethylene alkyl ethers, polyoxyethylene castor oil derivatives, polyoxyethylene sorbitan fatty acid esters, polyethylene glycols, polyoxyethylene stearates, colloidal silicon dioxide, phosphates, sodium dodecylsulfate, carboxymethylcellulose calcium, carboxymethylcellulose sodium, methylcellulose, hydroxyethylcellulose, hydroxypropyl celluloses, hydroxypropyl methylcellulose, hydroxypropylmethyl-cellulose phthalate, noncrystalline cellulose, magnesium aluminum silicate, triethanolamine, polyvinyl alcohol, polyvinylpyrrolidone, tyloxapol, poloxamers, poloxamines, Tetronic 1508®, dialkylesters of sodium sulfosuccinic acid, sodium lauryl sulfate, alkyl aryl polyether sulfonate, a mixture of sucrose stearate and sucrose distearate, p-isononylphenoxypoly-(glycidol), Crodestas SL-40®, $C_{18}H_{37}CH_2C(O)N(CH_3)$—$CH_2(CHOH)_4(CH_2OH)_2$, decanoyl-N-methylglucamide, n-decyl β-D-glucopyranoside, n-decyl β-D-maltopyranoside, n-dodecyl β-D-glucopyranoside, n-dodecyl β-D-maltoside, heptanoyl-N-methylglucamide, n-heptyl-β-D-glucopyranoside, n-heptyl β-D-thioglucoside, n-hexyl β-D-glucopyranoside, nonanoyl-N-methylglucamide, n-noyl β-D-glucopyranoside, octanoyl-N-methylglucamide, n-octyl-β-D-glucopyranoside, octyl β-D-thioglucopyranoside, lysozyme, PEG-derivatized phospholipid, PEG-derivatized cholesterol, PEG-derivatized cholesterol derivative, PEG-derivatized vitamin A, PEG-derivatized vitamin E, and random copolymers of vinyl pyrrolidone and vinyl acetate.

30. The system of claim 26, wherein the surface stabilizer is selected from the group consisting of cationic polymers, cationic biopolymers, cationic polysaccharides, cationic cellulosics, cationic alginates, cationic phospholipids, cationic lipids, and nonpolymeric cationic compounds.

31. The system of claim 26, wherein the surface stabilizer is selected from the group consisting of poly-n-methylpyridinium, anthryul pyridinium chloride, dimyristoyl phophatidyl glycerol, chitosan, polylysine, polyvinylimidazole, polybrene, polymethylmethacrylate trimethylammoniumbromide bromide, hexyldesyltrimethylammonium bromide, and polyvinylpyrrolidone-2-dimethylaminoethyl methacrylate dimethyl sulfate, sulfonium, phosphonium, quarternary ammonium compounds, benzyl-di(2-chloroethyl)ethylammonium bromide, coconut trimethyl ammonium chloride, coconut trimethyl ammonium bromide, coconut methyl dihydroxyethyl ammonium chloride, coconut methyl dihydroxyethyl ammonium bromide, dodecyl trimethyl ammonium bromide, decyl triethyl ammonium chloride, decyl dimethyl hydroxyethyl ammonium chloride, decyl dimethyl hydroxyethyl ammonium bromide, $C_{12-15}$dimethyl hydroxyethyl ammonium chloride, $C_{12-15}$dimethyl hydroxyethyl ammonium bromide, coconut dimethyl hydroxyethyl ammonium chloride, coconut dimethyl hydroxyethyl ammonium bromide, myristyl trimethyl ammonium methyl sulphate, lauryl dimethyl benzyl ammonium chloride, lauryl dimethyl benzyl ammonium bromide, lauryl dimethyl(ethenoxy)$_4$ ammonium chloride, lauryl dimethyl(ethenoxy)$_4$ ammonium bromide, N-alkyl($C_{12-18}$)dimethylbenzyl ammonium chloride, N-alkyl($C_{14-18}$)dimethylbenzyl ammonium chloride, N-tetradecylidmethylbenzyl ammonium chloride monohydrate, dimethyl didecyl ammonium chloride, N-alkyl 1-napthylmethyl ammonium chloride, ($C_{12-14}$)dimethyl 1-napthylmethyl ammonium chloride, trimethylammonium halide, alkyl-trimethylammonium salts, dialkyl-dimethylammonium salts, lauryl trimethyl ammonium chloride, ethoxylated alkyamidoalkyldialkylammonium salt, an ethoxylated trialkyl ammonium salt, dialkylbenzene dialkylammonium chloride, N-didecyldimethyl ammonium chloride, N-tetradecyldimethylbenzyl ammonium, chloride monohydrate, N-alkyl($C_{12-14}$)dimethyl 1-naphthylmethyl ammonium chloride, dodecyldimethylbenzyl ammonium chloride, dialkyl benzenealkyl ammonium chloride, lauryl trimethyl ammonium chloride, alkylbenzyl methyl ammonium chloride, alkyl benzyl dimethyl ammonium bromide, $C_{12}$ trimethyl ammonium bromides, $C_{15}$ trimethyl ammonium bromides, $C_{17}$ trimethyl ammonium bromides, dodecylbenzyl triethyl ammonium chloride, poly-diallyldimethylammonium chloride, dimethyl ammonium chlorides, alkyldimethylammonium halogenides, tricetyl methyl ammonium chloride, decyltrimethylammonium bromide, dodecyltriethylammonium bromide, tetradecyltrimethylammonium bromide, methyl trioctylammonium chloride, POLYQUAT 10™M, tetrabutylammonium bromide, benzyl trimethylammonium bromide, choline esters, benzalkonium chloride, stearalkonium chloride compounds, cetyl pyridinium bromide, cetyl pyridinium bromide chloride, halide salts of quaternized polyoxyethylalkylamines, MIRAPOL™, ALKAQUAT™, alkyl pyridinium salts, amines, amine salts, amine oxides, imide azolinium salts, protonated quaternary acrylamides, methylated quaternary polymers, and cationic guar.

32. The system of claim 26, wherein the surface stabilizer is selected from the group consisting of benzalkonium chloride, a carbonium compound, a phosphonium compound, an oxonium compound, a halonium compound, a cationic organometallic compound, a quarternary phosphorous compound, a pyridinium compound, an anilinium compound, an immonium compound, a hydroxylammonium compound, a primary ammonium compound, a secondary ammonium compound, a tertiary ammonium compound, behenalkonium chloride, benzethonium chloride, cetylpyridinium chloride, behentrimonium chloride, lauralkonium chloride, cetalkonium chloride, cetrimonium bromide, cetrimonium chloride, cethylamine hydrofluoride, chlorallylmethenamine chloride (Quaternium-15), distearyldimonium chloride (Quaternium-5), dodecyl dimethyl ethylbenzyl ammonium chloride (Quaternium-14), Quaternium-22, Quaternium-26, Quaternium-18 hectorite, dimethylaminoethylchloride hydrochloride, cysteine hydrochloride, diethanolammonium POE (10) oletyl ether phosphate, diethanolammonium POE (3)oleyl ether phosphate, tallow alkonium chloride, dimethyl dioctadecylammoniumbentonite, stearalkonium chloride, domiphen bromide, denatonium benzoate, myristalkonium chloride, laurtrimonium chloride, ethylenediamine dihydrochloride, guanidine hydrochloride, pyridoxine HCl, iofetamine hydrochloride, meglumine hydrochloride, methylbenzethonium chloride, myrtrimonium bromide, oleyltrimonium chloride, polyquaternium-1, procainehydrochloride, cocobetaine, stearalkonium bentonite, stearalkoniumhectonite, stearyl trihydroxyethyl propylenediamine dihydrofluoride, tallowtrimonium chloride, and hexadecyltrimethyl ammonium bromide.

33. The system of claim 1, wherein the milled material has an effective average particle size of less than about 2 microns.

34. The system of claim 33, wherein the milled material has an effective average particle size selected from the group consisting of less than about 1900 nm, less than about 1800 nm, less than about 1700 nm, less than about 1600 nm, less than about 1500 nm, less than about 1400 nm, less than about 1300 nm, less than about 1200 nm, less than about 1100 nm, less than about 1000 nm, less than about 900 nm, less than about 800 nm, less than about 700 nm, less than about 600 nm, less than about 500 nm, less than about 400 nm, less than about 300 nm, less than about 250 nm, less than about 200 nm, less than about 150 nm, less than about 100 nm, less than about 75 nm, and less than about 50 nm.

35. A method for milling at least one material comprising:

(a) providing a milling chamber having a milling head located therein;

(b) providing the at least one material in said milling chamber;

(c) providing at least one milling media in said milling chamber;

(d) providing a shaft arranged to be rotated about a longitudinal axis by a source of energy; and (e) magnetically coupling said shaft to said milling head to rotate said milling head about said axis in said milling chamber, whereupon rotation of said shaft about said axis effects the concomitant rotation of said milling head to effect the milling of the at least one material within said milling chamber.

36. The method of claim 35, wherein said milling chamber is releasably mounted on said shaft, and wherein said method comprises removing said milling chamber and said milling head as a unit from said shaft.

37. The method of claim 35, wherein said milling media comprise a plurality of small bodies.

38. The method of claim 37, wherein said small bodies have a particle size selected from the group consisting of less than about 500 microns, less than about 100 microns, less than about 75 microns, less than about 50 microns, less than about 25 microns, less than about 5 microns, less than about 3 mm, less than about 2 mm, less than about 1 mm, less than about 0.25 mm, and less than about 0.2 mm.

39. The method of claim 35, wherein said at least one milling media comprise a polymeric material.

40. The method of claim 35, wherein the material is a drug.

41. The method of claim 40, wherein the drug is poorly soluble and is dispersible in at least one liquid medium.

42. The method of claim 41, wherein the liquid medium is selected from the group consisting of water, aqueous salt solutions, safflower oil, ethanol, t-butanol, hexane, and glycol.

43. The method of claim 40, wherein the drug is selected from the group consisting of peptides, proteins, peptide mimetics, antigens, vaccines, hormones, analgesics, anti-migraine agents, anti-coagulant agents, medications directed to the treatment of diseases and conditions of the central nervous system, narcotic antagonists, immunosuppressants, agents used in the treatment of AIDS, chelating agents, anti-anginal agents, chemotherapy agents, sedatives, antineoplastics, prostaglandins, antidiuretic agents, DNA molecules to support gene therapy, and DNNRNA molecules to support gene therapy.

44. The method of claim 40, wherein the drug is selected from the group consisting of insulin, calcitonin, calcitonin gene regulating protein, atrial natriuretic protein, betaserori, erythropoietin, alpha interferon, beta interferon, gamma interferon, somatropin, somatotropin, somastostatin, insulin-like growth factor, luteinizing hormone releasing hormone, factor VIII, interleukins, interleukin analogues, hematological agents, anticoagulants, hematopoietic agents, hemostatics, thrombolytic agents, endocrine agents, antidiabetic agents, antithyroid agents, beta-adrenoceptor blocking agents, growth hormones, growth hormone releasing hormone, sex hormones, thyroid agents, parathyroid calcitonin, biphosphonates, uterine-active agents, cardiovascular agents, antiarrhythmic agents, anti-anginal agents, anti-hypertensive agents, vasodilators, agents used in treatment of heart disorders, cardiac inotropic agents, renal agents, genitounnary agents, antidiuretic agents, respiratory agents, antihistamines, cough suppressants, parasympathomimetics, sympathomimetics, xanthines, central nervous system agents, analgesics, anesthetics, anti-emetic agents, anorexiants, antidepressants, anti-migraine agents, antiepileptics, dopaminergics, anticholinergics, antiparkinsonian agents, muscle relaxants, narcotic antagonists, sedatives, stimulants, treatments for attention deficit disorder, methylphenidate, fluoxamine, bisolperol, tactolimuls, sacrolimus, cyclosporine, gastrointestinal agents, systemic anti-infectives, agents used in the treatment of AIDS, anthelmintics, antimycobacterial agents, immunologic agents, vaccines, hormones; dermatological agents including, anti-inflammatory agents, elastase inhibitors, antimuscarinic agents, lipid regulating agents, blood products, blood substitutes, antineoplastic agents including, leuprolide acetate, chemotherapy agents, oncology therapies, nutrients, nutritional agents, chelating agents.

45. The method of claim 44, wherein the drug is selected from the group consisting of interleukin-2, IL-1ra, heparin, hirudin, colony stimulating factors, tissue plasminogen activator, estradiol, oxytocin, nitroglycerine, diltiazem, clonidine, nifedipine, verapamil, isosorbide-5-mononitrate, organic nitrates, diuretics, desmopressin, vasopressin, expectorants, mucolytics, fentanyl, sufentanil, butorphanol, buprenorphine, levorphanol, morphine, hydromorphone, hydrocodone, oxymorphone, methadone, lidocaine, bupivacaine, diclofenac, naproxen, paverin, scopolamine, ondansetron, domperidone, metoclopramide, sumatriptan, ergot alkaloids, benzodiazepines, phenothiozines, prostaglandins antibiotics, antiviral agents, anti-fungals, immunosuppressants, anti-allergic agents, astringents, corticosteroids fluorouracil, bleomycin, vincristine, and deferoxamine.

46. The method of claim 35, wherein the material is a diagnostic aid.

47. The method of claim 46, wherein the diagnostic aid is selected from the group consisting of diagnostic agents, diagnostic imaging agents, radio-pharmaceuticals, and contrast media.

48. The method of claim 35, wherein the milled material has an effective average particle size of less than about 2 microns.

49. The method of claim 48, wherein the milled material has an effective average particle size selected from the group consisting of less than about 1900 nm, less than about 1800 nm, less than about 1700 nm, less than about 1600 nm, less than about 1500 nm, less than about 1400 nm, less than about 1300 nm, less than about 1200 nm, less than about 1100 nm, less than about 1000 nm, less than about 900 nm, less than about 800 nm, less than about 700 nm, less than about 600 nm, less than about 500 nm, less than about 400 nm, less than about 300 nm, less than about 250 nm, less than about 200 nm, less than about 150 nm, less than about 100 nm, less than about 75 nm, and less than about 50 nm.

50. The method of claim 35, wherein the material is milled in the presence of at least one surface stabilizer.

51. The method of claim 50, wherein the surface stabilizer is selected from the group consisting of a nonionic surfactant, an anionic surfactant, a cationic surfactant, a zwitterionic surfactant, and an ionic surfactant.

52. The method of claim 50, wherein the surface stabilizer is selected from the group consisting of gelatin, casein, lecithin, dextran, gum acacia, cholesterol, tragacanth, stearic acid, benzalkonium chloride, calcium stearate, glycerol monostearate, cetostearyl alcohol, cetomacrogol emulsifying wax, sorbitan esters, polyoxyethylene alkyl ethers, polyoxyethylene castor oil derivatives, polyoxyethylene sorbitan fatty acid esters, polyethylene glycols, polyoxyethylene stearates, colloidal silicon dioxide, phosphates, sodium dodecylsulfate, carboxymethylcellulose calcium, carboxymethylcellulose sodium, methylcellulose, hydroxyethylcellulose, hydroxypropyl celluloses, hydroxypropyl methylcellulose, hydroxypropylmethyl-cellulose phthalate, noncrystalline cellulose, magnesium aluminum silicate, triethanolamine, polyvinyl alcohol, polyvinylpyrrolidone, tyloxapol, poloxamers, poloxamines, Tetronic 1508®, dialkylesters of sodium sulfosuccinic acid, sodium lauryl sulfate, alkyl aryl polyether sulfonate, a mixture of sucrose stearate and sucrose distearate, p-isononylphenoxypoly-(glycidol), Crodestas SL-40®, $C_{18}H_{37}CH_2C(O)N(CH_3)$—$CH_2(CHOH)_4(CH_2OH)_2$, decanoyl-N-methylglucamide, n-decyl β-D-glucopyranoside, n-decyl β-D-maltopyranoside, n-dodecyl β-D-glucopyranoside, n-dodecyl β-D-maltoside, heptanoyl-N-methylglucamide, n-heptyl-β-D-glucopyranoside, n-heptyl β-D-thioglucoside, n-hexyl β-D-glucopyranoside, nonanoyl-N-methylglucamide, n-noyl β-D-glucopyranoside, octanoyl-N-methylglucamide, n-octyl-β-D-glucopyranoside, octyl β-D-thioglucopyranoside, lysozyme, PEG-derivatized phospholipid, PEG-derivatized cholesterol, PEG-derivatized cholesterol derivative, PEG-derivatized vitamin A, PEG-derivatized vitamin E, and random copolymers of vinyl pyrrolidone and vinyl acetate.

53. The method of claim 50, wherein the surface stabilizer is selected from the group consisting of cationic polymers, cationic biopolymers, cationic polysaccharides, cationic cellulosics, cationic alginates, cationic phospholipids, cationic lipids, and nonpolymeric cationic compounds.

54. The method of claim 50, wherein the surface stabilizer is selected from the group consisting of poly-n-methylpyridinium, anthryul pyridinium chloride, dimyristoyl phophatidyl glycerol, chitosan, polylysine, polyvinylimidazole, polybrene, polymethylmethacrylate trimethylammoniumbromide bromide, hexyldesyltrimethylammonium bromide, and polyvinylpyrrolidone-2-dimethylaminoethyl methacrylate dimethyl sulfate, sulfonium, phosphonium, quarternary ammonium compounds, benzyl-di(2-chloroethyl)ethylammonium bromide, coconut trimethyl ammonium chloride, coconut trimethyl ammonium bromide, coconut methyl dihydroxyethyl ammonium chloride, coconut methyl dihydroxyethyl ammonium bromide, dodecyl trimethyl ammonium bromide, decyl triethyl ammonium chloride, decyl dimethyl hydroxyethyl ammonium chloride, decyl dimethyl hydroxyethyl ammonium bromide, $C_{12-15}$dimethyl hydroxyethyl ammonium chloride, $C_{12-15}$dimethyl hydroxyethyl ammonium bromide, coconut dimethyl hydroxyethyl ammonium chloride, coconut dimethyl hydroxyethyl ammonium bromide, myristyl trimethyl ammonium methyl sulphate, lauryl dimethyl benzyl ammonium chloride, lauryl dimethyl benzyl ammonium bromide, lauryl dimethyl(ethenoxy)$_4$ ammonium chloride, lauryl dimethyl(ethenoxy)$_4$ ammonium bromide, N-alkyl($C_{12-18}$)dimethylbenzyl ammonium chloride, N-alkyl($C_{14-18}$)dimethylbenzyl ammonium chloride, N-tetradecylidmethylbenzyl ammonium chloride monohydrate, dimethyl didecyl ammonium chloride, N-alkyl 1-napthylmethyl ammonium chloride, ($C_{12-14}$)dimethyl 1-napthylmethyl ammonium chloride, trimethylammonium halide, alkyl-trimethylammonium salts, dialkyl-dimethylammonium salts, lauryl trimethyl ammonium chloride, ethoxylated alkyamidoalkyldialkylammonium salt, an ethoxylated trialkyl ammonium salt, dialkylbenzene dialkylammonium chloride, N-didecyldimethyl ammonium chloride, N-tetradecyldimethylbenzyl ammonium, chloride monohydrate, N-alkyl($C_{12-14}$)dimethyl 1-naphthylmethyl ammonium chloride, dodecyldimethylbenzyl ammonium chloride, dialkyl benzenealkyl ammonium chloride, lauryl trimethyl ammonium chloride, alkylbenzyl methyl ammonium chloride, alkyl benzyl dimethyl ammonium bromide, $C_{12}$ trimethyl ammonium bromides, $C_{15}$ trimethyl ammonium bromides, $C_{17}$ trimethyl ammonium bromides, dodecylbenzyl triethyl ammonium chloride, poly-diallyldimethylammonium chloride, dimethyl ammonium chlorides, alkyldimethylammonium halogenides, tricetyl methyl ammonium chloride, decyltrimethylammonium bromide, dodecyltriethylammonium bromide, tetradecyltrimethylammonium bromide, methyl trioctylammonium chloride, POLYQUAT 10™, tetrabutylammonium bromide, benzyl trimethylammonium bromide, choline esters, benzalkonium chloride, stearalkonium chloride compounds, cetyl pyridinium bromide, cetyl pyridinium bromide chloride, halide salts of quaternized polyoxyethylalkylamines, MRAPOL™, ALKAQUAT™, alkyl pyridinium salts, amines, amine salts, amine oxides, imide azolinium salts, protonated quaternary acrylamides, methylated quaternary polymers, and cationic guar.

55. The method of claim 50, wherein the surface stabilizer is selected from the group consisting of benzalkonium chloride, a carbonium compound, a phosphonium compound, an oxonium compound, a halonium compound, a cationic organometallic compound, a quarternary phosphorous compound, a pyridinium compound, an anilinium compound, an immonium compound, a hydroxylammonium compound, a primary ammonium compound, a secondary ammonium compound, a tertiary ammonium compound, behenalkonium chloride, benzethonium chloride, cetylpyridinium chloride, behentrimonium chloride, lauralkonium chloride, cetalkonium chloride, cetrimonium bromide, cetrimonium chloride, cethylamine hydrofluoride, chlorallylmethenamine chloride (Quaternium-15), distearyldimonium chloride (Quaternium-5), dodecyl dimethyl ethylbenzyl ammonium chloride (Quaternium-14), Quaternium-22, Quaternium-26, Quaternium-18 hectorite, dimethylaminoethylchloride hydrochloride, cysteine hydrochloride, diethanolammonium POE (10) oletyl ether phosphate, diethanolammonium POE (3)oleyl ether phosphate, tallow alkonium chloride, dimethyl dioctadecylammoniumbentonite, stearalkonium chloride, domiphen bromide, denatonium benzoate, myristalkonium chloride, laurtrimonium chloride, ethylenediamine dihydrochloride, guanidine hydrochloride, pyridoxine HCl, iofetamine hydrochloride, meglumine hydrochloride, methylbenzethonium chloride, myrtrimonium bromide, oleyltrimonium chloride, polyquaternium-1, procainehydrochloride, cocobetaine, stearalkonium bentonite, stearalkoniumhectonite, stearyl trihydroxyethyl propylenediamine dihydrofluoride, tallowtrimonium chloride, and hexadecyltrimethyl ammonium bromide.

56. The method of claim 35, wherein the material is milled in the presence of at least two surface stabilizers.

* * * * *